US009482392B2

(12) United States Patent
Baumeister et al.

(10) Patent No.: US 9,482,392 B2
(45) Date of Patent: Nov. 1, 2016

(54) LIGHT FIXTURE AND LAMP AND SUPPORT AT THE LIGHT FIXTURE AND SUPPORT ELEMENT AT THE LAMP AND LAMP HOLDER AND LAMP SOCKET

(71) Applicant: BJB GmbH & Co. KG, Arnsberg (DE)

(72) Inventors: Olaf Baumeister, Sundern (DE); Markus Schulte, Moehnesee (DE)

(73) Assignee: BJB GmbH & Co. KG, Arnsberg (DE)

( * ) Notice: Subject to any disclaimer, the term of this patent is extended or adjusted under 35 U.S.C. 154(b) by 77 days.

(21) Appl. No.: 14/562,737

(22) Filed: Dec. 7, 2014

(65) Prior Publication Data

US 2015/0204522 A1 Jul. 23, 2015

(30) Foreign Application Priority Data

Jan. 21, 2014 (DE) ..... 10 2014 000 741

(51) Int. Cl.

| | |
|---|---|
| ***F21V 19/00*** | (2006.01) |
| ***F21K 99/00*** | (2016.01) |
| ***F21S 2/00*** | (2016.01) |
| ***F21V 21/02*** | (2006.01) |
| *F21Y 101/02* | (2006.01) |
| *F21Y 103/00* | (2016.01) |

(52) U.S. Cl.

CPC ..... *F21K 9/17* (2013.01); *F21K 9/175* (2013.01); *F21S 2/00* (2013.01); *F21S 4/28* (2016.01); *F21V 19/0005* (2013.01); *F21V 19/008* (2013.01); *F21V 19/0085* (2013.01); *F21V 21/025* (2013.01); *F21Y 2101/02* (2013.01); *F21Y 2103/003* (2013.01); *Y10T 29/49826* (2015.01)

(58) Field of Classification Search

CPC ..... F21V 19/001; F21V 19/0005; F21V 19/008; F21V 19/0085; F21V 19/04; F21V 19/0015; F21K 9/17; F21K 9/30

USPC ..... 362/217.16

See application file for complete search history.

(56) References Cited

U.S. PATENT DOCUMENTS 5,636,919 A * 6/1997 Walker ..... F21V 19/0085 362/217.14
8,092,038 B2 * 1/2012 Liao ..... F21V 19/004 362/217.1

(Continued)

FOREIGN PATENT DOCUMENTS

| | | | |
|---|---|---|---|
| DE | 19833720 | C1 | 5/2000 |
| DE | 202013001101 | U1 | 4/2013 |
| DE | 202013100401 | U1 | 5/2013 |
| JP | H10317660 | A | 12/1998 |
| JP | 2003129728 | A | 5/2003 |
| JP | 2005171614 | A | 6/2005 |
| JP | 2010170742 | A | 8/2010 |
| JP | 2010198784 | A | 9/2010 |

*Primary Examiner* — Karabi Guharay

(74) *Attorney, Agent, or Firm* — Von Rohrscheidt Patents

(57) ABSTRACT

A light fixture for supporting a lamp at two ends, the light fixture including a lamp holder which receives and supports a lamp socket arranged at a first end of a lamp, wherein the lamp holder includes lamp holder contacts which electrically connect with lamp socket contacts; and a support which receives and supports a support element arranged at a second end of the lamp, wherein the support mechanically supports the lamp in the light fixture and does not include electrical contacts, wherein the support is essentially pot-shaped, wherein two opposite face walls are arranged at a base of the support, wherein the face walls and the side walls define a receiving cavity which is accessible through an opening and which includes a push-in section arranged in front in a push in direction and a support section arranged in a rear in the push-in direction.

25 Claims, 12 Drawing Sheets

(56) References Cited

U.S. PATENT DOCUMENTS

| | | | |
|---|---|---|---|
| 2010/0008085 | A1 | 1/2010 | Ivey et al. |
| 2010/0159724 | A1 | 6/2010 | Ida et al. |
| 2012/0049739 | A1 | 3/2012 | Clough |
| 2012/0307524 | A1 | 12/2012 | Schapira et al. |
| 2013/0002164 | A1 | 1/2013 | Galluccio et al. |
| 2013/0049591 | A1* | 2/2013 | Quercia ..... F21V 17/06 315/86 |
| 2013/0201687 | A1 | 8/2013 | Matsushima |
| 2014/0233225 | A1 | 8/2014 | Veilleux |

* cited by examiner

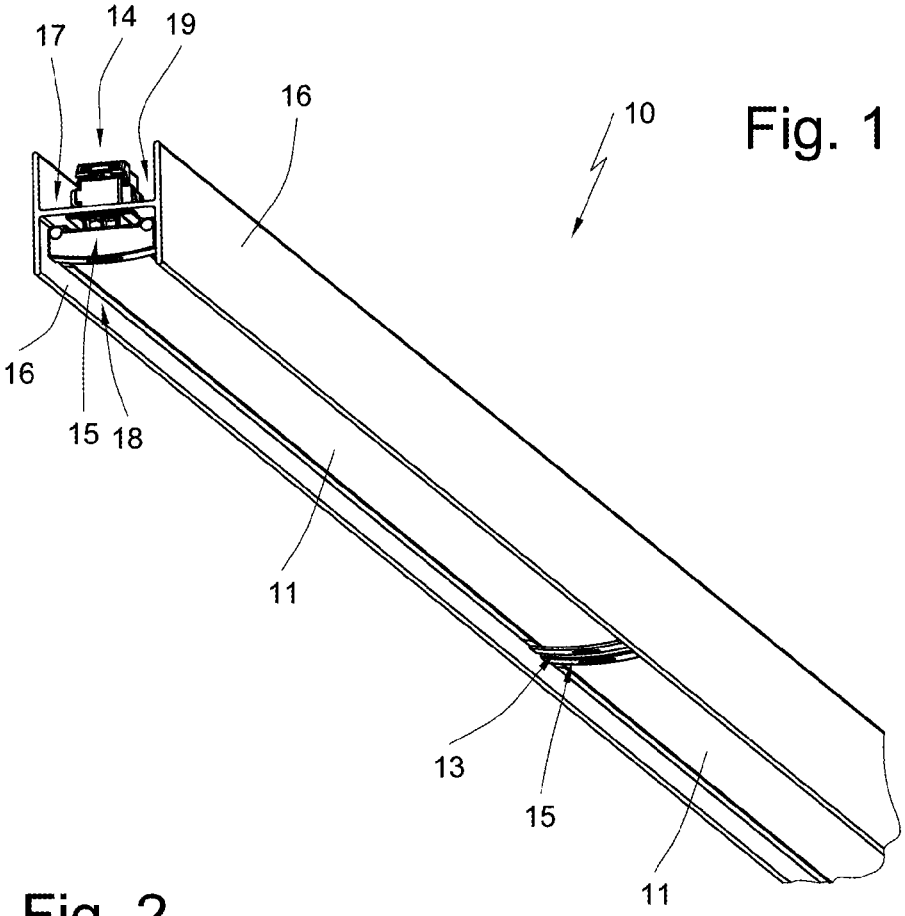
Fig. 1
Fig. 2
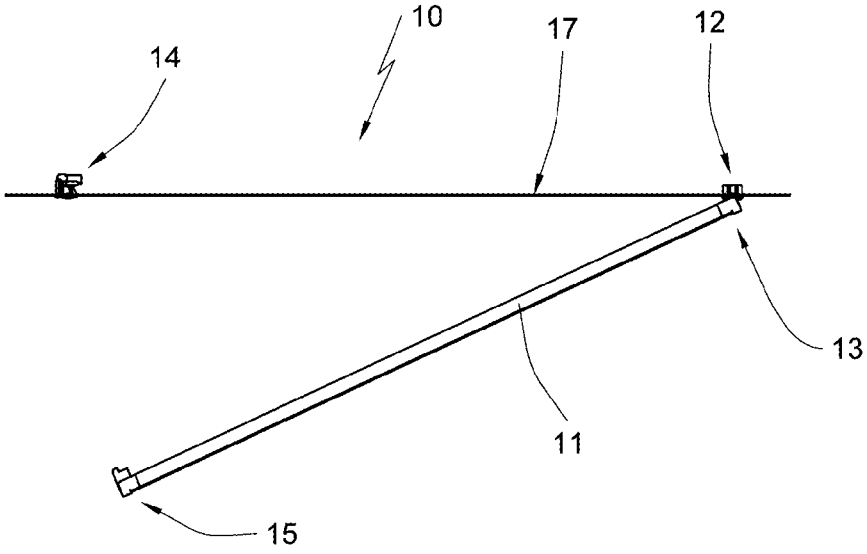

LIGHT FIXTURE AND LAMP AND SUPPORT AT THE LIGHT FIXTURE AND SUPPORT ELEMENT AT THE LAMP AND LAMP HOLDER AND LAMP SOCKET

RELATED APPLICATIONS

This application claims priority from and incorporates by reference German patent application DE 10 2014 000 741.3 filed on Jan. 21, 2014.

FIELD OF THE INVENTION

The invention relates to a light fixture and a lamp.

BACKGROUND OF THE INVENTION

Lamps with lamp sockets on both sides, in particular fluorescent lamps are well-known in the art. Reference is made for example to DE 10 2007 054 930 A1 co-owned by applicant. Fluorescent tubes of this type with sockets on both sides include socket contacts configured as contact pins at their respective ends, wherein the socket contacts are respectively inserted into a lamp holder. These are typically sockets with a rotor in which the contact pins are provided to the rotor through a slot in the holder housing and are moved into a contact position through subsequent rotation of the lamp while moving the rotor along in which contact position the socket contacts become electrically connected with the contact pins of the lamp and a mechanical support of the lamp is also provided. Lamps of this type are used in light fixtures which implement elongated light bands in offices and industrial buildings, warehouses and even in private homes. Fluorescent lamps with sockets on both sides have become popular in many areas due to their lighting options and also because they have a higher light output at identical electric power compared to other conventional illuminants.

Fluorescent lamps with sockets on both sides, however, have a few disadvantages when inserting and dismounting the lamp since the socket contact pins of both lamp ends are typically not synchronously insertable into the holders, which is on the one hand side due to user handling and caused by the fact that inserting the socket contact pins into the tight insertion openings of the holders is imprecise. The longer the fluorescent lamp is itself, the more uncomfortable it is to handle. Due to low intrinsic stability of the fluorescent lamps a user has to be very careful not to destroy the lamp during insertion or through unintentional dropping.

Furthermore, rather elongated fluorescent lamps with sockets on one side are known in the art which are inserted into light fixtures having only one lamp holder. In order to reduce mechanical loading of the holder and to provide correct orientation of the lamp in the light fixture, the lamps can be provided with an additional support for the fluorescent lamp, wherein the additional support typically is an interlocking element. The interlocking element partially envelops the fluorescent lamp which does not have any additional support device itself. Thus, reference is made to articles 26.746.1001 and 26.726-013 in the catalogue 2008-2011 on pages [03] 52 through [02] 54 of the applicant. In systems of this type mounting the fluorescent lamp can be easily performed through lateral insertion. Typically significant forces have to be applied for inserting the lamp into the holder. However, since the holder for the lamp socket includes a mounting movement end stop, a user has the additional safety of not losing the lamp out of his hand unintentionally. The same applies for interlocking the lamp in the support element at the light fixture. Also here, the support element includes a mounting end stop for the fixation movement.

Dismounting a fluorescent lamp of this type is much more inconvenient for the user since the sensitive fluorescent lamp has to be pulled out of the interlocking support element of the light fixture with comparatively high force and has to be pulled out of the lamp holder thereafter. The typically sudden overcoming of the support forces of the support element and of the holder causes a sudden movement of the lamp in dismounting direction which induces the risk that the lamp is accidentally dropped or that the lamp impacts the light fixture housing.

Old lamp shapes have an additional disadvantage in that a concatenation of plural lamps does not produce light in sections that are covered by the lamp sockets and the lamp holders. This generates shaded portions in light bands that are formed from plural lamps.

Last not least LED lamps are known in the art as replacement for fluorescent lamps. These LED lamps, however, use the known socket and holder systems. In order to be used as retrofit and replacement lamps for existing light fixtures such LED lamps emulate the classic configurations of fluorescent lamps.

In particular, LED lamps configured as classic fluorescent tubes typically include an aluminum body for cooling the LEDs, which aluminum body extends over an entire length of the lamp. Compared to the glass tube of a fluorescent lamp there are significant lengths expansions caused by operational heating which can cause tensions in the installed lamp or even a deformation of the entire light fixture. Additionally, there are contact problems when the socket contacts disengage from the holder contacts due to length reduction during cooling of the lamp.

BRIEF SUMMARY OF THE INVENTION

Thus, it is an object of the invention to improve mounting of a lamp, in particular an LED lamp, in particular for a lamp which can be used for providing improved elongated light bands.

The object is achieved initially by a light fixture for supporting a lamp at two ends, the light fixture including a lamp holder which receives and supports a lamp socket arranged at a first end of a lamp, wherein the lamp holder includes lamp holder contacts which electrically connect with lamp socket contacts; and a support which receives and supports a support element arranged at a second end of the lamp, wherein the support mechanically supports the lamp in the light fixture and does not include electrical contacts, wherein the support is essentially pot-shaped, wherein two opposite face walls are arranged at a base of the support, wherein the two opposite face walls support two opposite side walls between each other, wherein the face walls and the side walls define a receiving cavity which is accessible through an opening and which includes a push-in section arranged in front in a push in direction and a support section arranged in a rear in the push-in direction, wherein the lamp holder is provided with a recess for receiving a mounting dome of the lamp socket, wherein a spring element is arranged in the recess, wherein the spring element impacts the mounting dome through a pressure plate, and wherein a support pin is arranged in the recess and linked in a spring-elastic manner.

The object is also achieved by a light fixture as described supra, wherein the support section of the support is formed by two bars that are arranged opposite to one another and oriented in the push-in direction, and wherein the two bars narrow the opening in a portion of the support section so that a groove is formed.

The object is also achieved by a light fixture, wherein at least one support surface is arranged in the receiving cavity of the support, and wherein the at least one support surface controls an insertion movement of the lamp in the push in direction.

The light fixture may include a support, wherein a support pin slides during a mounting movement along the displacement section of the movement path and penetrates the return section at an end of the mounting movement until the support pin is anchored in the arresting section.

The lamp may advantageously include and anchor pinion that is narrower than an anchor head and anchor section is configured overall substantially T-shaped.

The lamp may also include a lamp element, wherein the support groove extends from an inlet opening through which the support pin is insertable into the support groove, and wherein the support groove terminates in an outlet opening through which the support pin is extractable.

The invention furthermore relates to a method for mechanically fixating a lamp described supra in a light fixture described supra including the steps moving the anchor section of the support element in a first linear movement through the opening into the receiving cavity of the support and there into the push-in section, and inserting the anchor section of the support element in a second linear movement into the support section of the receiving cavity of the support.

An essential advantage of the invention is that the light fixture forms a support which is only used for mechanically fixating the lamp, and which is not used additionally for electrically contacting and which is furthermore configured to receive a support element that is only used for mechanically fixating the lamp. Since components are provided on the light fixture side and also on the lamp side which are only used in cooperation with one another to mechanically fixate the lamp in the light fixture there is the option to optimize these components for maximum operator comfort, minimum size and advantageous positioning at the light fixture and at the lamp.

In view of the art recited supra and the object of the invention, another solution provides a lamp with the features of claim 2, in particular with its characterizing features, according to which the support element is only used for mechanically fixating the lamp in the light fixture and configured without electrical contacts, wherein the support element is insertable into a support at the light fixture that is only used for mechanically fixating the lamp.

The advantages of the lamp are analogous to the advantages of the light fixture. Also here the lamp side support element through its combined interaction with the light fixture side support provides the option to configure the support element only for an easily manageable mechanical connection with the light fixture so that no compromises have to be made regarding electrical contacting.

The invention furthermore relates to a support for a lamp at a light fixture component with an essentially pot shaped base element, wherein two opposite face walls are arranged at a bottom of the base element, wherein the two opposite face walls support two opposite side walls between each other, wherein the face walls and side walls enclose a receiving cavity that is accessible through an opening which is divided into a push in section and a retaining section that is in the back in push in direction. The essential advantage of the support is that it operates without interlocking devices or clamping devices in this simple embodiment so that the lamp can be mounted in the support essentially without force.

An advantageous embodiment of the invention is characterized in that the support section is formed by two opposite bars that are oriented in push in direction which narrow the opening in the portion of the retaining section so that a groove is formed.

It is provided that a support element is only used for mechanically fixating the lamp in the light fixture and is configured without electrical contacts, wherein the support element is insertable into the support at the light fixture that is only used for mechanically fixating the lamp. Thus, the bars of the support are oriented approximately transversal to gravity for a ceiling mount so that the support element of the lamp can rest on the bars. In this particular embodiment it is evident, that an interlocking or clamping fixation is not required in the support at the light fixture so that simple mounting and in particular dismounting of the lamp is provided.

It is furthermore provided that at least one support surface is arranged in the receiving cavity which support surface controls the push in movement of a lamp element that is to be inserted. The support surfaces are used for further improving the process of inserting the support element into the support. The support surfaces provide that the insertion into the support is a continuous movement and wedging the support element during mounting in the support is avoided. In particular, the support surfaces convert the insertion movement into the push in section into a push in movement into the retaining section.

In particular it is provided that the support surface extends from a face wall that is in front in push in direction and that the support surface is sloped towards the base, in particular when the support surface extends parallel to the base from the face wall arranged upfront in push in direction to the face wall that is arranged in the rear in push in direction.

It is furthermore provided that the retaining cavity of the retaining section formed between the bars and the base is sized so that a support element of a lamp to be inserted is essentially supportable without clearance.

It is furthermore is provided that the retaining cavity is defined between the bars and the base side support surface.

Furthermore it is provided for simple mounting of the support in the light fixture element that the face and/or side walls include external interlocking devices in order to be able to fixate the support in a cut-out of the light fixture element. However, alternatively it is also conceivable that the support element is an integral part of the light fixture element.

Another embodiment of the invention is implemented in a support element of a lamp with a receiving cavity defined by a support element base and support element side walls for a support element of a lamp, wherein one of the support element side walls includes an external anchoring section for mechanically fixating the lamp at a light fixture.

An essential advantage of the purpose configured support element is that it can be configured optimized solely for the support function. Differently from the prior art it is not necessary to comply with other requirements, e.g. good electrical contacting. Compared to other art recited supra, this purpose configured support element has the advantage on the lamp side that it is configured less sensitive compared to the lamp cylinder so that it can be easily gripped by the user during mounting and dismounting of the lamp.

In a particular embodiment it is provided that an anchor section of the support element includes an anchor head which is fixated at the support element side wall by an anchoring pin, in particular when the anchoring pin is narrower than the anchoring head and the anchoring section is configured overall approximately T-shaped.

This configuration of the anchoring section facilitates ideal interaction with the support described supra in that the particularly T-shaped anchoring section is supported in the retaining section of the support on the bars, whereas the anchoring pin exits between the bars so that it supports the lamp.

It is provided that the anchor head is configured drum-shaped at least at its end sections. In particular in combination with the support surfaces on sides of the support provided supra the drum-shaped end sections provide a comfortable sliding assembly.

The invention furthermore relates to a system for mechanically fixating a lamp in a light fixture with a support according to one of the claims 3-10 and a support element according to one of the claims 11-14, wherein the anchor section of the support element is supported in the retaining section of the support in order to provide a mechanical fixation of the lamp at the light fixture, wherein the anchor section is in particular pivotably supported in the support in order to facilitate a pivot movement from a mounting position of the lamp into a functional position of the lamp.

It is appreciated that the support can be configured according to the support element and the support element can then be configured according to the support. In this case the support element is attached at the light fixture, the support, however, is attached at the lamp. Since in this embodiment only the arrangement of support and support element at the light fixture or lamp is changed, however, the function is not changed, a configuration of this type can be considered equivalent.

In order to be able to operate a lamp in a light fixture, an electrical connection between lamp and light fixture is required in addition to the cooperation of support and support element, thus the mechanical connection of the lamp in the light fixture. Therefore, the invention also relates to an alternative embodiment of a support element which can be used as a lamp socket with socket contacts for electrically contacting holder contacts. This support element is provided with a mounting dome that is configured for inserting into a second embodiment of a support which can be used as lamp holder and which includes a support pin that is linked in a spring-elastic manner for mechanically anchoring the support element, wherein the mounting dome includes support surfaces which form a movement path along which the support pin is supportable, wherein the movement path is configured to displace the support pin through a displacement section from an idle position in a first direction building up spring loading during a relative movement of the support element and the support, to return the support pin back towards its idle position through a return section while partially reducing the spring loading, to retain the support pin in an arresting section which forms part of the return section while maintaining a spring loading.

A support element of this type or a lamp socket of this type is part of a so-called push-in-push-out arrangement in which the lamp socket is retained by pressing the holder/support into an anchoring position and the lamp socket is moved into a disengagement or dismounting position by repeated pressing into the support. During the first impression of the support element into the support, the support pin arranged in the support is moved into an arresting section of the support element and thus, keeps the support element in a mounting position. In this mounting position a mechanical anchoring of the support element and thus of the lamp in the light fixture is provided in the support. Also an electrical connection between holder contacts and socket contacts is conceivable when the support and the support element are configured as holder and socket.

It is provided in an advantageous embodiment of the support element according to the invention that a movement path of a continued relative movement of support and support element is configured to disengage the support pin out of the arresting section and to move it from the return section into an extraction section of the movement path while reducing the residual spring load.

An essential advantage is that another impression of the support element into the support disengages the support pin from the arresting section and transfers it into the extraction section so that the support element can be removed from the support. Thus, when removing the support element from the support no additional force is required in this embodiment. Rather, the support element slides out of the support quasi self-acting. At the most, a certain amount of friction may retain the support element that is connected with the lamp support element in the support under the weight of the lamp.

In order to prevent accidental sliding of the support element out of the support and to thus support the lamp in the support, also in case of an intentional or unintentional disengagement of the support pin out of the arresting section, it is provided that the arresting section is configured to displace the support pin into a second direction while building up a spring load again, wherein the second displacement direction is opposite to the first displacement direction.

An essential advantage is that the support pin can only slide through the extraction section while building up an additional spring tension. This spring tension is sized so that it easily prevents a sliding of the support pin out of the arresting section solely due to the weight of the lamp.

Eventually it is provided that the support surfaces are associated with a support groove that is fabricated in a side wall of the mounting dome.

It is furthermore provided that the support groove originates from an insertion opening through which the support pin is insertable into the support groove and that the support groove terminates in an outlet opening through which the support pin is removable.

For a cooperation with the support element described supra a support is required that is configured accordingly. Thus, the invention also relates to a support with a recess for receiving a mounting dome of a support element in which a spring loaded pressure plate is arranged and with a support pin that is arranged in the recess wherein the support pin is linked under a spring load, and optionally with holder contacts for electrically connecting to contacts of a lamp socket when the support is configured as a lamp holder.

An essential advantage of this support is its interaction with the support element recited supra which implements a so-called push-in-push-out principle for anchoring the support element in the support. This is characterized in that pushing the socket into the holder initially provides mechanical anchoring and electrical contacting and another pushing of the lamp socket into the holder causes a disengagement of the socket from the holder. A central element is the support pin at the holder which is initially moved into an idle position and then into a disengagement position through the spring elastic displacement in cooperation with the support surfaces of the lamp. The spring loaded pressure plate provides that the support pin remains safely in the socket side arresting section and the support element is moved out of the support after another pushing of the support element into the support.

The invention furthermore relates to a system for mechanically fixating a support element according to claim 16 in a support according to claim 21 wherein the mounting dome of the support element is introduced in mounting direction into the receiving cavity of the support, wherein the pressure plate is displaced from its idle position by the mounting dome causing a build-up of spring tension, and the pressure plate pressing against mounting direction retains the support pin of the support in the arresting direction and thus, retains the support element in the support.

The system according to the invention is characterized in that the support pin is disengaged from the arresting section under repeated movement of the mounting dome in mounting direction and further displacement of the pressure plate and then transitioned into the extraction section.

It is furthermore provided that the spring tension of the pressure plate induces a dismounting movement of the mounting dome which moves the support pin along the extraction section and which causes a spring elastic displacement of the support pin.

Then, as recited supra, the system is configured so that the frictional engagement between the support pin that is elastically displaced in the extraction section and the support surface of the extraction section retains the support pin in the extraction section and prevents an exit of the support pin through the outlet opening.

From the statements provided supra it is apparent to a person skilled in the art that the configuration of support element and support is reversible, thus the support can have the features of the support element and the support element can have the features of the support. In so far a respective configuration of support element and support can be considered an equivalent solution.

Additionally it becomes clear that adding cooperating contact elements to the support and the support element converts them into a holder and a lamp socket.

The invention furthermore relates to a method for mechanically fixating a lamp in a light fixture wherein the lamp includes a support element according to one of the claims 1 through 11 and the light fixture includes a support according to one of the claims 3 through 10, characterized in that the anchor section of the support element is moved into the receiving cavity of the support and there into the push in section in a first linear movement through the opening, and in a second also linear movement the anchor section is inserted into the support section of the receiving cavity of the support.

In another embodiment is provided that the anchor head is inserted into the push in section and pushed into the support section, the anchor pin, however, is pushed between the groove-forming bars.

Eventually it is provided that the support surface transposes the first linear movement into the second linear movement.

The invention also relates to a method for mechanically fixating a lamp with a support element according to one of the claims 16 through 20, and a lamp with a support according to claim 21, characterized in that the mounting dome is inserted through a mounting movement in a mounting direction into the recess of the holder, wherein the support pin impacts at least one support surface of the displacement section and the pressure plate of the support is moved by first distance while building up spring loading.

The invention is furthermore implemented in that the support pin slides through the mounting movement along the deflection section of the movement path, and penetrates the return section at the end of the mounting movement until it is anchored in the arresting section.

Then it is provided that a dismounting movement is performed for disengaging the arrested support pin wherein the dismounting movement has the same direction as the mounting movement.

Eventually the method is implemented in that the support pin moves into the extraction section when performing the dismounting movement.

It is also provided that the support pin is moved through the extraction section of the movement path again being displaced against the spring force when continuing the dismounting with a reversed movement direction.

Eventually it is provided that the continued dismounting movement is induced by the spring-loaded pressure plate of the holder with a movement direction against the mounting movement.

BRIEF DESCRIPTION OF THE DRAWINGS

The invention will now be described based on advantageous embodiments with reference to drawing figures, wherein:

FIG. 1 illustrates a light fixture according to the invention with lamps according to the invention;

FIG. 2 illustrates a schematic representation of a mounting situation of a lamp according to the invention in a light fixture according to the invention;

DETAILED DESCRIPTION OF THE INVENTION

Figure 3:
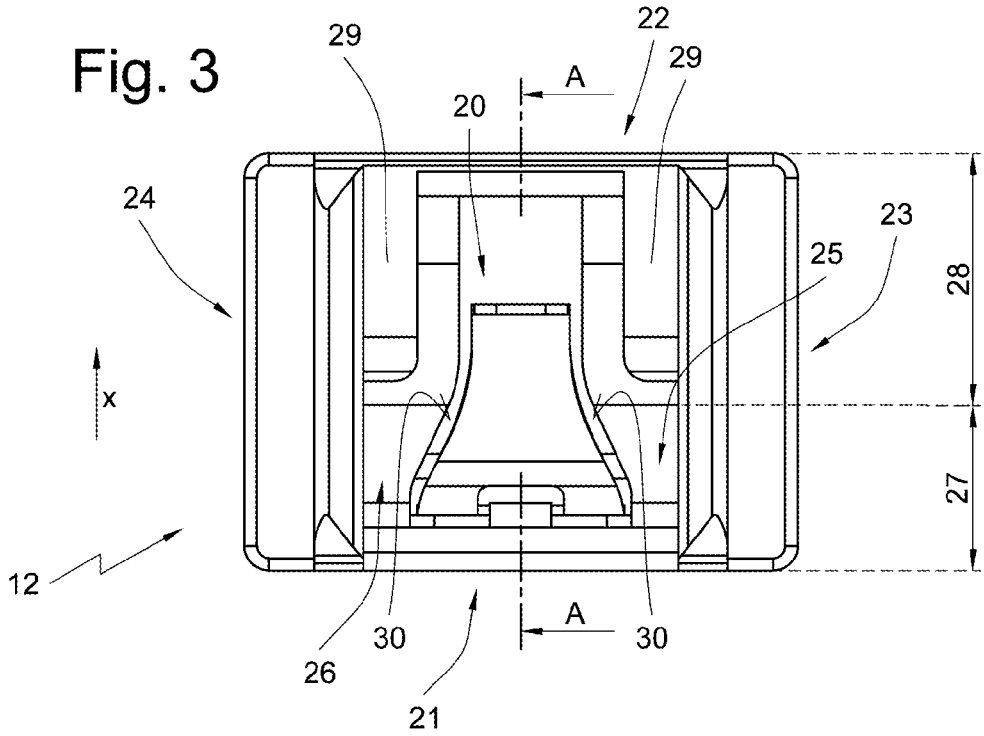
FIG. 3 illustrates a support according to the invention in a view from below.

The drawing figures illustrate a light fixture according to the invention designated over all with the reference numeral 10. The light fixture is illustrated in FIG. 1 in a perspective view.

The light fixture 10 receives at least one, in the present embodiment, however, plural elongated lamps 11 that are assembled to form a linear light band. For mechanical anchoring of the lamp 11 the light fixture 10 includes a support 12 which cooperates with a support element 13 of the lamp 11. The support 12 and the support element 13 are thus used exclusively for mechanically fixating the lamp 11 at the light fixture 10, whereas a holder 14 at the light fixture and a socket 15 at the lamp are used for mechanically fixating the lamp 11 in the light fixture 10 and for electrical connection. The socket 15 is arranged at a first end of the lamp 11, the support element 13 is arranged a second end of the lamp 11 so that the lamp type according to the invention is a lamp type that is supported on two sides.

The light fixture 10 is configured very simple in this embodiment. This is an h-beam with two vertical arms 16 that are off-set from one another and a horizontal arm 17 connecting the vertical arms 16. This way the light fixture 10 forms a receiving cavity 18 oriented towards a viewer for receiving the lamp 11 and a supply cavity 19 that is oriented away from the viewer, wherein the supply cavity receives the holder 14, the support 12, attachment elements for arranging the lamp at building elements and for example power carrying cables and control conductors.

The lamp itself is configured as a LED lamp which does not only have advantageous properties with respect to energy consumption but in which the light direction can be influenced by arranging individual LEDs. This way also the gap between two lamps 11 that are arranged behind one another which gap is otherwise shaded by the socket 15 or the support element 13 can be illuminated for the viewer so that a light band with a continuous even light output is generated.

Figure 4:
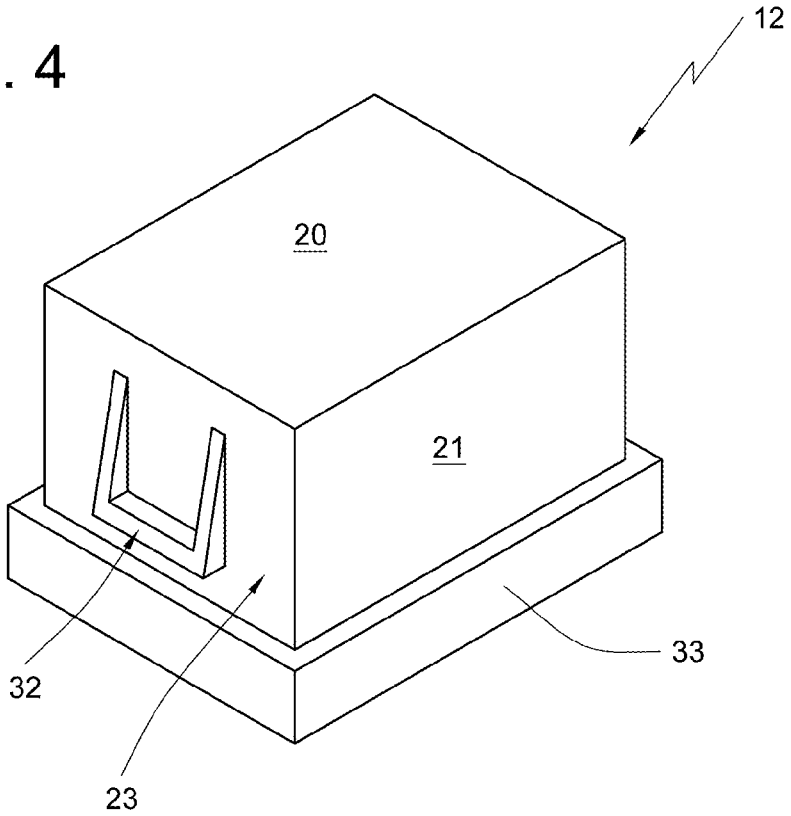
FIG. 4 illustrates the support according to FIG. 3 in a perspective view from above.
Figure 5:
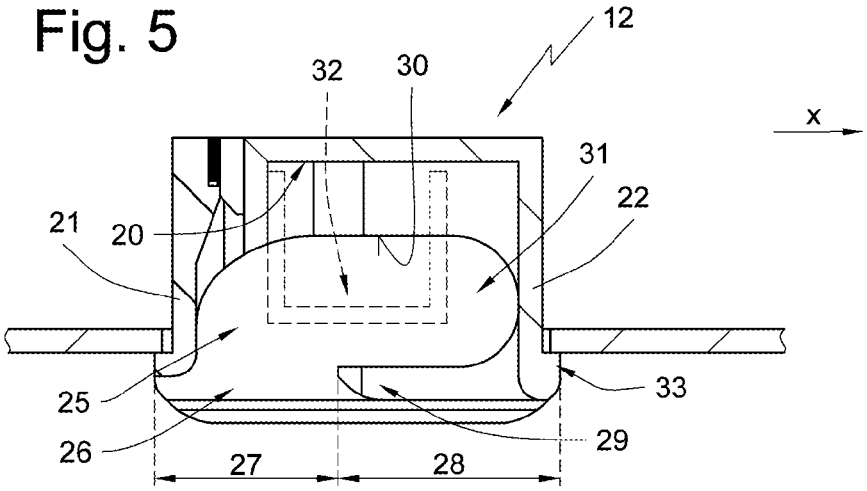
FIG. 5 illustrates the support according to FIG. 3 in a sectional view along the section line A-A in FIG. 3.

The support 12 by itself is illustrated in FIGS. 3 through 5. It can be derived from the view from below (FIG. 3) initially that the support 12 forms a substantially pot-shaped base element, whose base 20 supports two face walls 21 and 22 that are arranged opposite to one another. Between the face walls 21 and 22 two side walls 23 and 24 are supported. The base 20, the face walls 21 and 22, and the side walls 23 and 24 form a receiving cavity 25 that is accessible through an opening 26. The opening 26 is divided in the push in direction X into a forward push in section 27 and a retaining section 28 that is arranged in a rear in push in direction X. The support section 28 is defined by two bars 29 that are oriented in push in direction X opposite to one another with an off-set there between wherein the bars narrow the opening 26 in the portion of the support section 28 to form a groove, so that the support section 28 is formed as an undercut retaining groove. The support section 28 is configured long enough in push in direction X so that at least production inherent longitudinal tolerances of the lamp 11 are compensated. However, it is advantageous to provide a space for compensating thermal expansions of the lamp 11 which will be described infra.

Support surfaces 30 are arranged in the receiving cavity 25 of the support 12 wherein the support surfaces are used for controlling the insertion movement in push in direction X of a support element 13. The support surfaces 30 extend from the first face wall 21, thus proximal to the opening 26, drop towards the ground 20 and extend parallel to the ground in the portion of the retaining section 28. A retaining cavity 31 of the retaining section 28 is thus formed between the bars 29 and the base 20.

As apparent from the perspective view of the support 12 in FIG. 4 the side walls 34 and 24 are provided with interlocking devices 32 that are used for anchoring the support element 13 in a cut-out of a fight fixture element. A circumferential shoulder 33 at the edge of the support 12 oriented towards the lamp 11 is used as reaction bearing which prevents a sliding of the support 12 through the recited cut-out of a light element. However, it is also conceivable that the support is an integral bonded element of a light fixture element and not produced as proposed supra as a separate component for outfitting a light fixture.

The sectional view of the support 12 along the sectional line A-A in FIG. 3 illustrates on the one hand side in particular the presence of the support cavity 31 in the support section 28 and the shape of the support surface 30. The support surface 30 drops from its origin close to the opening in the first face wall 21 along a circular path section until approximately to the level of the base 20. Alternatively the drop shape can also be configured differently. Their shape advantageously corresponds with a support element 13 to be inserted.

Figure 6:
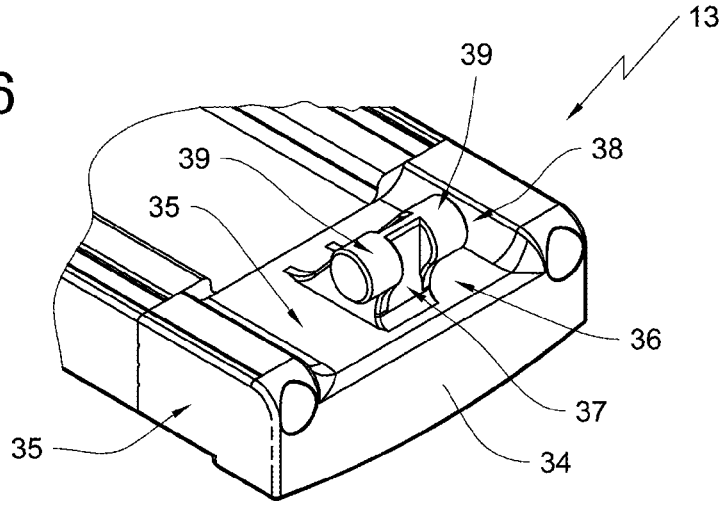
FIG. 6 illustrates a support element according to the invention in a perspective view.

A support element 13 corresponds to the support 12 for mechanically fixating the lamp 11 in the light fixture 10, wherein the support element is illustrated in a perspective view in FIG. 6.

The support element 13 according to the invention contacts at an end of the lamp 11 and thus forms a portion of the lamp housing. For this purpose, a support element base 34 supports support element side walls 35 which form a receiving cavity for lamp elements which receiving cavity is oriented away from the viewer in FIG. 6. The support element 13 is, therefore, approximately configured like a cap which is insertable onto the end of the lamp 11 and which forms for example support elements for a cover glass 43 and a circuit board 44 that is provided with LEDs. The support element 13 is provided with an anchor section 36 for mechanically fixating the lamp 11 at the light fixture 10 at a support element side wall 35 that is oriented towards the light fixture. This anchor section 36 forms an anchor pin 37 which extends from the support element side wall 35 and which includes an anchor head 38 at its free end. The anchor section 36 is thus configured approximately T-shaped. The end sections 39 of the anchor head 38 are formed approximately drum-shaped.

FIG. **6*a* illustrates an alternative embodiment of the support 13 according to FIG. 5. This embodiment differs from the support 13 according to FIG. 5 in particular in that a spring element 40 is arranged in the receiving cavity 25 wherein a spring arm 41 of the spring element 40 is arranged in the support cavity 31. When the support element 13 is inserted into the support 12 the spring arm 41 is displaced from its idle position by the anchor section 36 in push in direction X. As an alternative to the leaf-spring element selected herein, other spring elements like for example coil springs are conceivable which are displaced from their idle position in push in direction X when the support element 13 is inserted into the support 12**.

The support element 13 and the support 12 cooperate as a system for mechanically fixating a lamp 11 in a light fixture 10. This type of interaction and the process of inserting the support element 13 into the support 12 is now described in more detail with reference to FIG. 7.

Figure 7:
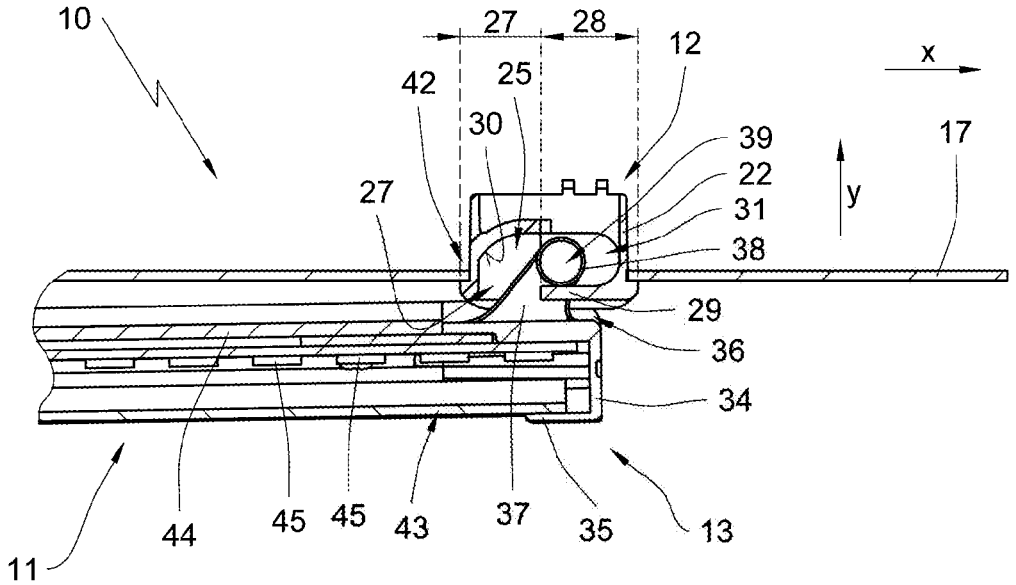
FIG. 7 illustrates a simplified partial sectional view in lamp longitudinal direction through the light fixture according to FIG. 1 with the support element in mounting position.

FIG. 7 is a partial sectional view of the light fixture 10 according to FIG. 1 looking at the arrangement portion of the support 12 and the support element 13. From the light fixture 10 only the horizontal arm 17 of the H-shaped light fixture profile is illustrated. The support 12 is interlocked in a cut-out 42 of the horizontal arm 17.

An end section of the lamp 11 in a sectional view is also visible in FIG. 7. From FIG. 7 it is apparent that the support element 13 with its support element base 34 and its support element walls 35 form a receiving cavity for lamp components. Within this receiving cavity that is not illustrated in more detail, end sections of the lamp cover 43 and of a circuit board 44 are supported, wherein the circuit board 44 is provided with plural LEDs 45.

The support element side wall 35 oriented towards the light fixture 10 as recited supra includes the anchor section 36 that is to be arranged below the support 12 in front of the opening 26 in the portion of the push in section 27. The anchor head 38 is now inserted in push in direction Y through the opening 26 into the receiving cavity 25 of the support element and then slides on the support surfaces 30 in push in direction X in order to penetrate the support cavity 31 of the support 12.

The anchor head 38 that is now inserted in the portion of the undercut support groove is connected to the lamp 11 through anchor pins 37 running out of the support 12 between the bars 29 and the anchor head supports the lamp at the light fixture 10 against the direction of gravity. The advantageous drum-shaped configuration of the end sections 39 of the anchor head 38 facilitates pivoting of the lamp 11 that is mechanically supported at the light fixture 10 in this condition only at one side, wherein the lamp is pivotable about the anchor head 38 as a center of the pivot movement. This is advantageous with respect to a connection of socket 15 and holder 14 which will be described infra.

From the illustrated interaction between support 12 and support element 13 it is clearly evident for everybody that the structural features of the support 11 can also be configured at the lamp to form a support element when the structural features of the support element 13, in particular the formation of the anchor section 36 are configured at the light fixture 10. Thus, this switch-over, this means configuring the support element 13 with features like the support 12 and simultaneously configuring the support 12 like the support element 13 are equivalent.

Figure 6A:
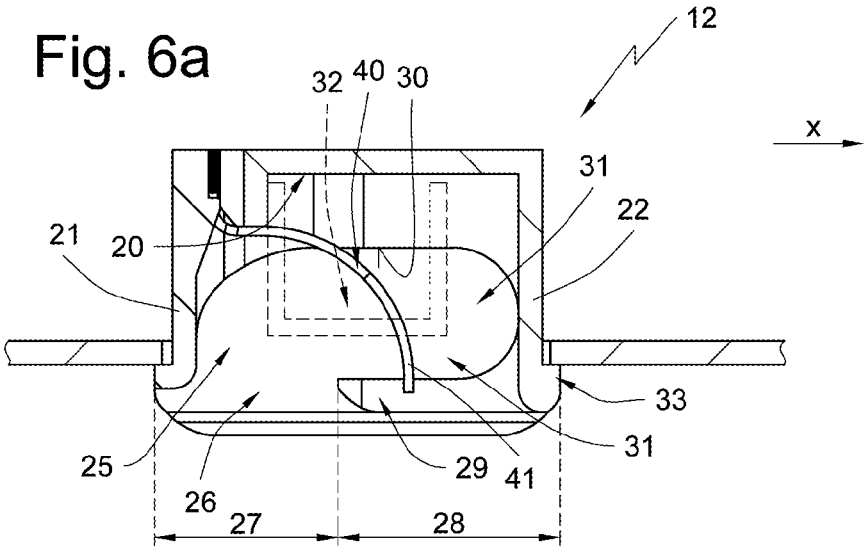
FIG. 6*a* illustrates the representation according to FIG. 5 with a second embodiment of the support.
Figure 9:
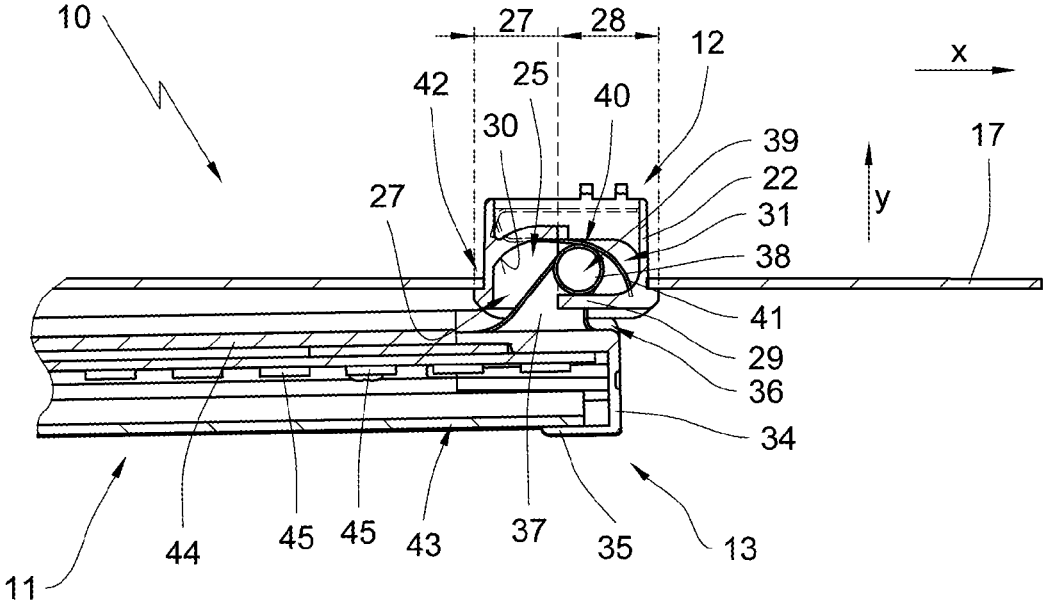
FIG. 9 illustrates the representation according to FIG. 7 with an alternative embodiment of the support.

FIG. 9 illustrates a representation analogous to FIG. 7, however, a support 12 was inserted into the light fixture wherein the support corresponds to the modified configuration of FIG. 6A. The configuration of FIG. 6A was accordingly supplemented with a spring element with spring arm 41. Also here the mounting process of the support element 13 in the support 12 will initially be performed according to the description FIG. 7.

However, in order to complete the mounting process in which the lamp has to be moved on in push in direction X until it reaches an end stop, the spring arm 41 is displaced from its idle position by the anchor head 38 and builds up a spring force that is oriented against the push in movement X. This has the effect that the spring arm 41 induces an ejection movement when dismounting the lamp 11 which requires a disengagement of socket and holder which will be described infra. Thus, the spring forces move the anchor head 38 into a direction that is opposite to the push in direction X until the spring arm 41 has reached its idle position. However, it is appreciated that the anchor head 38 is moved by the spring arm 41 in a direction of the push in section 27 of the support 12 when dismounting the lamp 11 in an advantageous embodiment, however, the anchor head 38 does not move into the push in section 27. Instead the anchor head remains in the support section 28 so that a transition into the push in section 27 and thus, a gravity-induced sliding of the anchor section 36 out of the support 12 does not occur.

Figure 8:
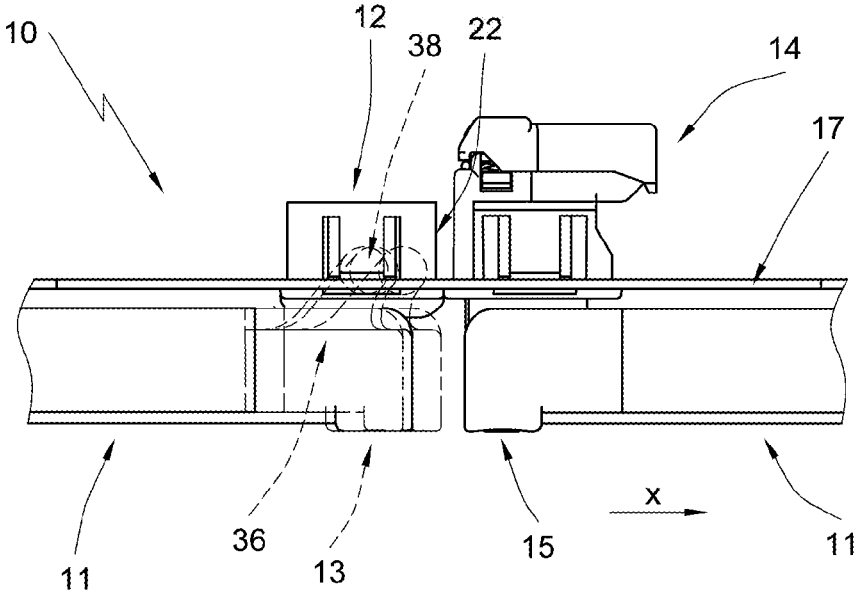
FIG. 8 illustrates a partial lateral view of the light fixture in FIG. 1.

In this context reference is made to FIG. 8 which illustrates a simplified detail of a lateral view of the light 10 in the portion of two lamps 11 arranged behind one another. In this representation the vertical arm 16 of the lamp 10 were omitted. The anchor section 36 including the support element 13 is illustrated in dashed lines in two different positions. In an offset arrangement of the lamps 11 the anchor head 38 has approximately the position illustrated in FIGS. 7 and 9 in the support section 28 of the support 12. Through a continuation of the insertion movement X the lamps 11 move directly adjacent to one another.

The lamp 11 which includes the illustrated end section with the socket 15, wherein the socket 15 is anchored in the holder 14 is already completely mounted, so that it is not forced to perform any movement in X-direction during the process described supra.

Figure 10:
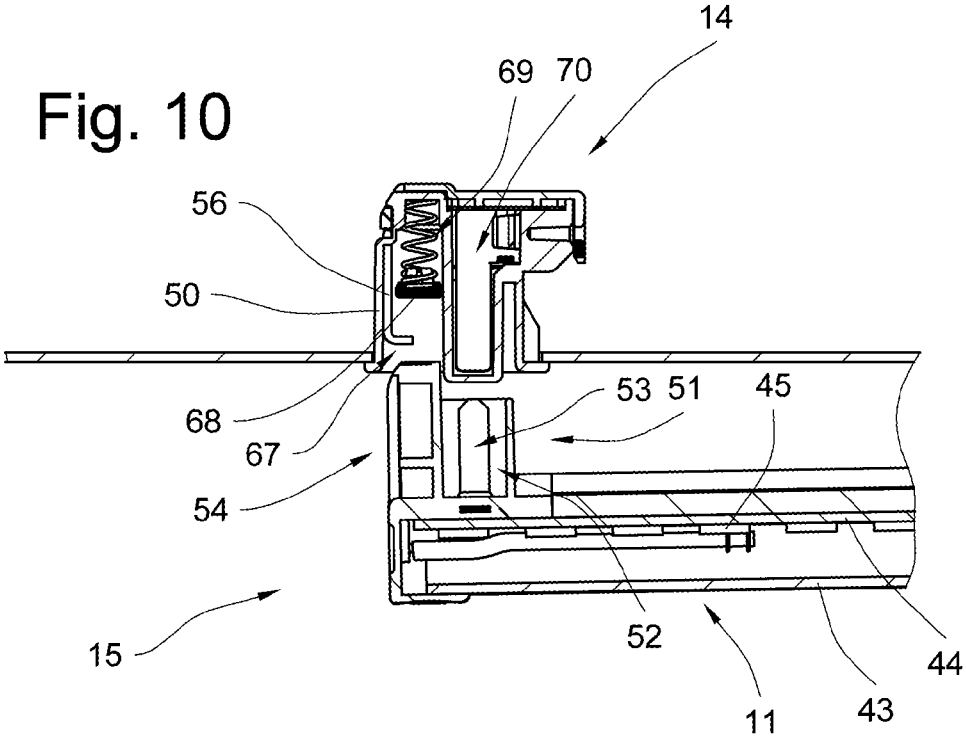
FIG. 10 illustrates a simplified partial sectional view of the light fixture according to FIG. 1 with a view of the arrangement portion of lamp socket and lamp holder.
Figure 10A:
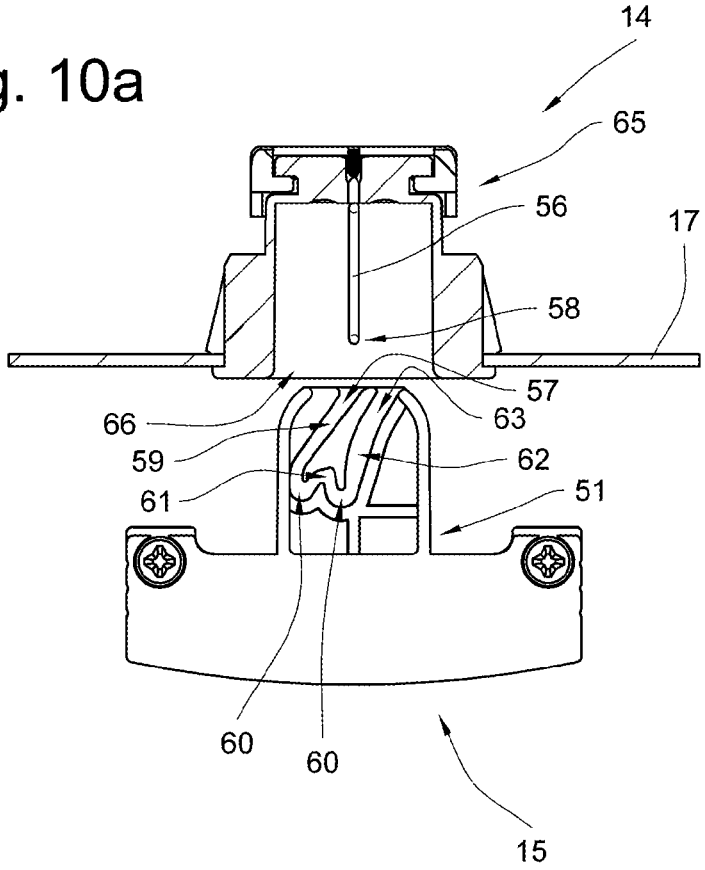
FIG. 10*a* illustrates a representation of an arrangement portion of lamp socket and lamp holder.
Figure 10B:
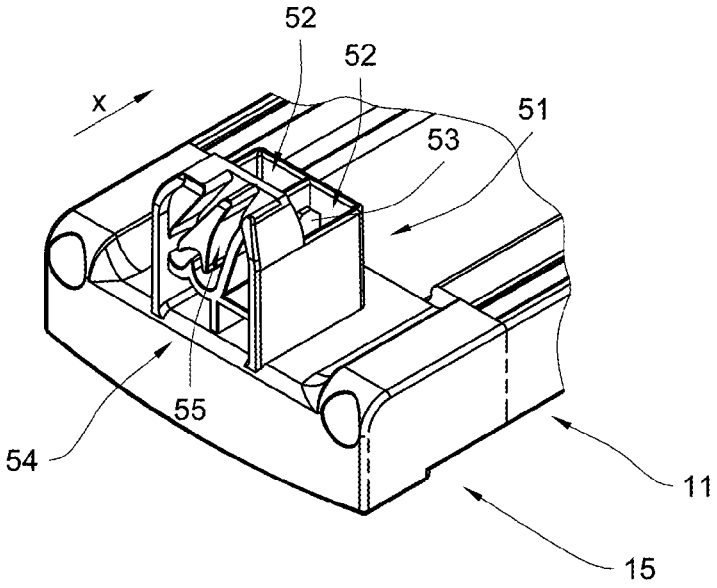
FIG. 10*b* illustrates a perspective view of lamp socket.

FIGS. 10 and 10*a* now describe another embodiment of support and support element. Both are provided with contacts in the instant embodiment wherein the contacts enter into an electrical connection in the mounted condition of the lamp 11. Insofar the support and the support element of this alternative embodiment are configured as holder 14 and socket 15 and are subsequently designated accordingly. Since the mechanical anchoring forms the core of the invention this terminology is not limiting. FIG. 10 illustrates a simplified partial sectional view of the light fixture 10 according to FIG. 1, wherein the arrangement portion of holder 14 and socket 15 is illustrated. FIG. 10*a* on the other hand side illustrates a view in push in direction X of the socket 15 and the holder 14, wherein the forward housing wall 50 that is in front in push in direction X and that is illustrated for the holder 14 in FIG. 10 is removed. FIG. 10*b* illustrates a perspective view of the lamp socket 16 in push in direction.

The lamp socket 15 similar to the support element 13 forms a pot-shaped recess for various lamp elements as apparent in particular from the sectional view of FIG. 10. The recess which is arranged in a mirror configuration compared to the support element 13 analogously receives the lamp cover 43 and the circuit board 44.

As initially apparent from the perspective illustration in FIG. 10*b* the lamp socket 15 includes a mounting dome 51 that is oriented in a direction towards the light fixture 10, wherein the mounting dome forms a contact recesses 52 in which socket contacts 53 are inserted. An attachment section 54 is arranged in front of the contact recesses 52 in push in direction X, wherein a surface of the attachment section which is arranged in front in push in direction X and oriented towards the front housing wall 50 of the holder includes a support groove 55 which forms support surfaces for a support pin 56 of the holder 14. These support surfaces form a movement path along which the support pin 56 is moveable as will be described infra.

The face view of the lamp holder 15 in FIG. 10A is particularly configured to describe individual sections of the support surfaces or the support groove 55.

The support groove 55 extends from an inlet opening 57 that is oriented towards the holder 14, wherein the inlet opening is aligned with a free end section 58 of the support pin 56 and is arranged in an embodiment in a plane that includes a longitudinal axis of the lamp and is oriented vertical to the horizontal arm 17.

Starting with the inlet opening 57 the support groove 55 initially forms the so-called displacement section 59. The displacement section extends at an angle to the vertical plane and transitions into a wave-shaped return section 60. This return section furthermore includes an arresting section 61 and transitions into the extraction section 62 which in turn leads into an outlet opening 63.

The holder 14 illustrated in FIG. 10A includes a holder recess 64 which is configured essentially shape complimentary to the mounting dome 51 of the socket 15. The recited support pin 56 of the holder 14 is fixated at one end in the holder housing 65 and oriented with its free end section 58 towards the insertion opening 66. The mounting dome 51 is insertable into the holder recess 64 through the insertion opening 66 that is oriented towards the socket 15.

The support pin 56 is also arranged in the vertical plane for the instant embodiment. For the subsequently described function, however, it is essential that the support pin is aligned with the inlet opening 57 of the support groove 55. The support pin 56 is furthermore configured spring elastic and is advantageously made from steel spring wire, wherein the free end section forms an arresting lug 67 through bending into push in direction X as apparent from the longitudinal sectional view of the lamp according to FIG. 10. For better visibility FIG. 10A differently from FIG. 10 does not illustrate the pressure plate 68 arranged in the holder recess 64, wherein the pressure plate can be pressure loaded through at least one coil spring 69.

Eventually the holder 14 forms a contact cavity 70 in which holder contacts can be arranged which electrically connect with the socket contacts 53.

The holder 14 and the socket 15 form a cooperating system for mechanically fixating the lamp socket 15 in the holder 14 and thus a system for mechanically supporting the lamp 11 in the lamp fixture 10 while simultaneously providing a respective voltage supply and a connection of electrical control conductors which for example can influence light color and light intensity of a LED lamp 11. This also implies a mounting method for inserting a lamp socket 15 in a lamp holder 14. This method will now be described in more detail with reference to FIGS. 11 through 14.

FIGS. 11*a*, 12*a*, 13*a*, and 14*a* respectively illustrate a side view of the light fixture 10 in the arrangement portion of the socket 15 and the holder 14 and they only differ in their respective arrangement position between the lamp 11 and the light fixture 10. In particular the different penetration depth of the mounting dome 51 of the socket 15 in the holder recess 64 of the holder 14 is illustrated. The corresponding illustrations 11*b*, 12*b*, and 12*c*, 13*b* and 13*c*, and 14*b* are illustrations analogous to FIG. 10*a*. Thus, these are views of the arrangement portion of holder 14 and socket 15 in push in direction X, wherein the forward housing wall 15 of the socket 14 is removed.

Inserting the socket 15 into the holder 14 and their interaction for mechanically anchoring the lamp 11 into the light fixture 10 is described infra.

Figure 11B:
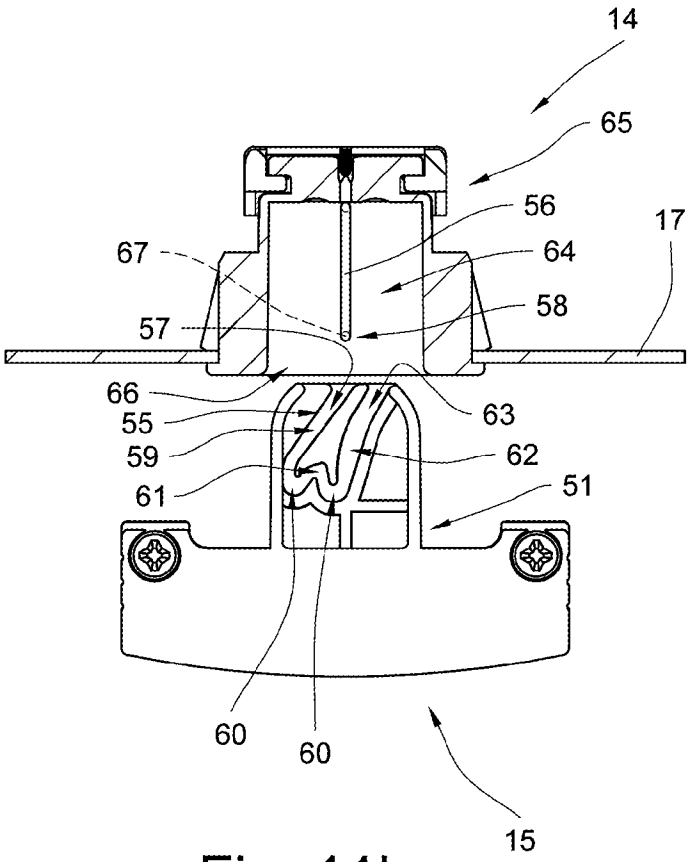
FIGS. 11*a* and *b* illustrate a representation of the arrangement portion of lamp socket and lamp holder in preassembled condition.
Figure 11A:
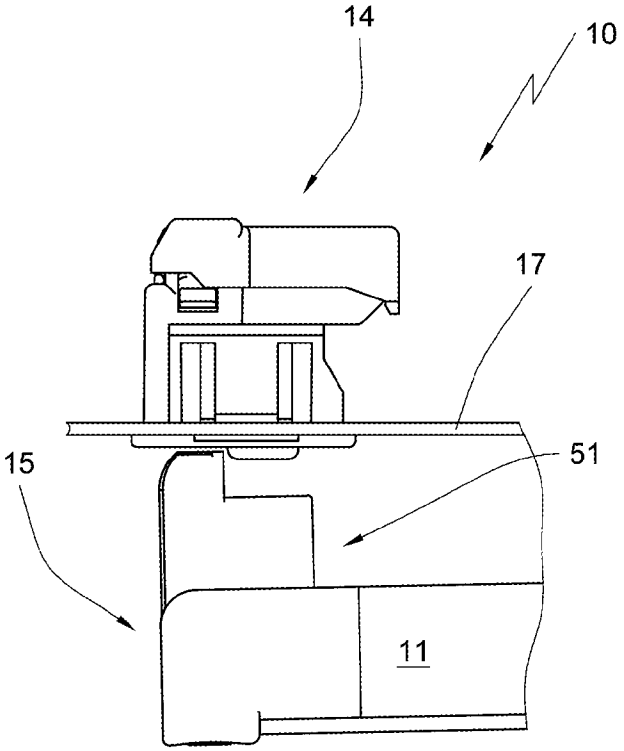

FIG. 11*a* illustrates a pre-assembly position in which the socket 15 is arranged with its mounting dome 51 so that it is oriented towards the holder 14 and its holder recess 64. As can be derived from FIG. 11*b* the support pin 56 which is displaceable against a spring force is arranged in its idle position, its arresting lug 67 is oriented towards the inlet opening 57 of the support groove 55.

Figure 12B:
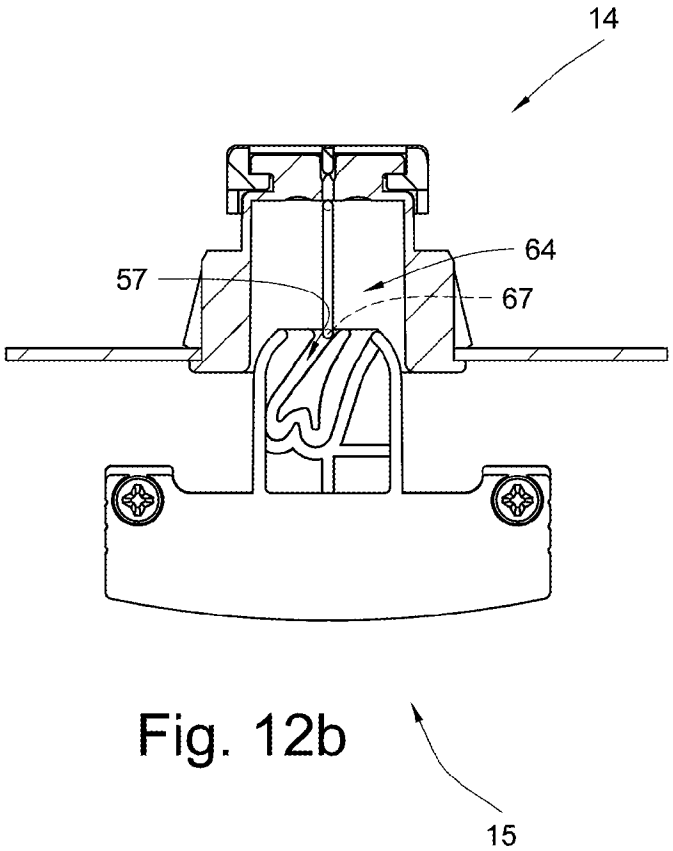
FIGS. 12*a*, 12*b* and 12*c* illustrate representations of the arrangement portion of lamp socket and lamp holder in order to illustrate the attachment process.
Figure 12A:
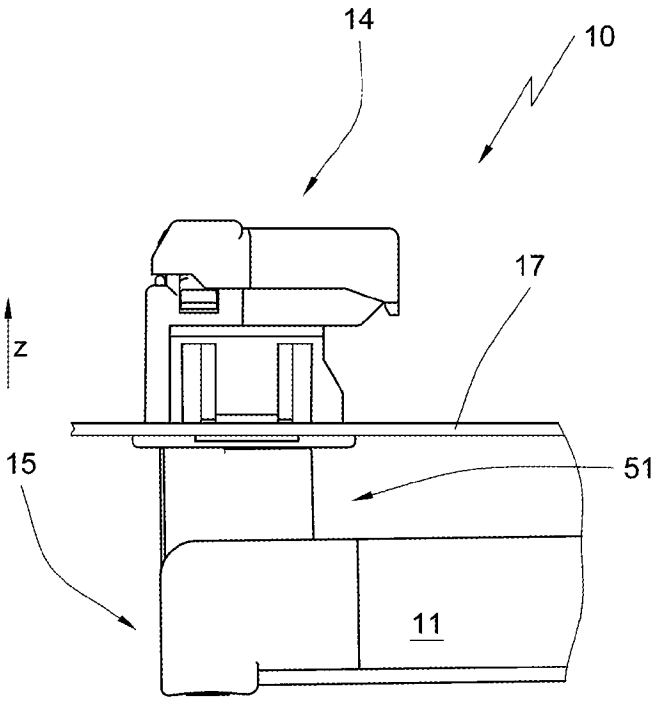

It is illustrated now in FIG. 12 that the mounting dome 51 is moved through the insertion opening 66 of the holder 14 by a certain distance into the holder recess 64. The arresting lug 67 of the support pin 56 penetrates through the inlet opening 57 of the support groove 55 into the support groove 55 (c.f. FIG. 12*b*). This happens in that the mounting dome 51 or the socket 15 is moved in push in direction Z. When continuing the movement, the arresting lug 67 slides along the displacement section 59 of the support groove 55, wherein the support pin 56 is displaced from its idle position against a spring force. The displacement section 59 thus encloses an angle with a plane that is oriented vertical to the horizontal arm 17 and extends through the longitudinal axis of the lamp and is inclined in push in direction Z relative to the plane.

Figure 12C:
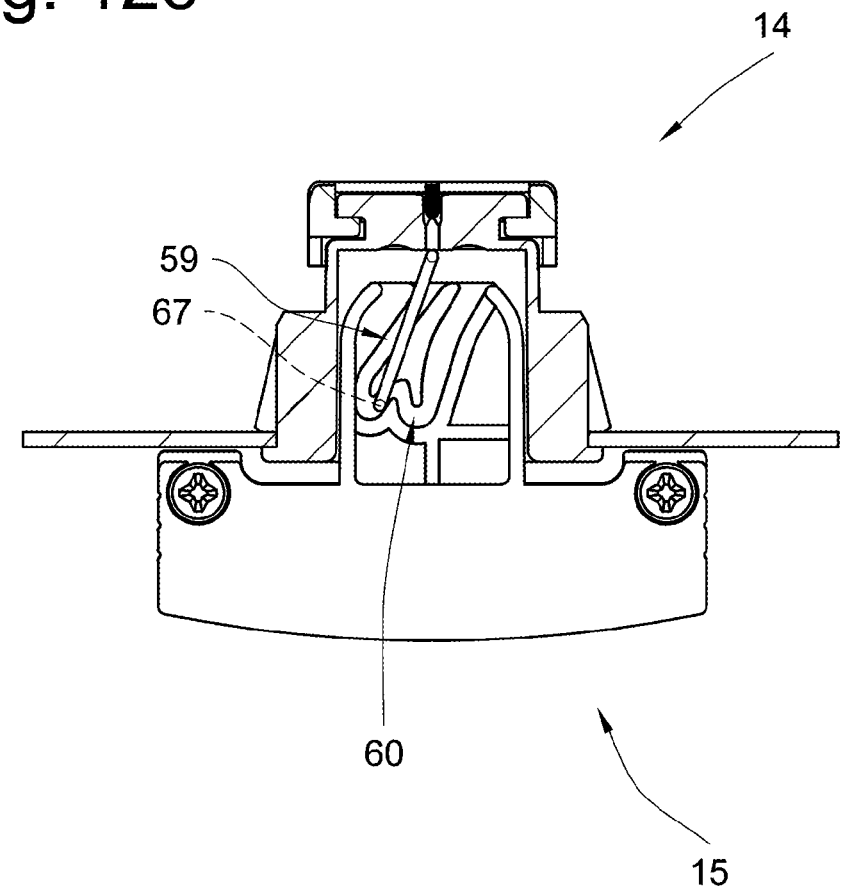

As illustrated in FIG. 12*c* the arresting lug 67 after completing its movement along the deflection section 59 moves into the so-called return section 60 which extends approximately transversal to the plane and which facilitates the return of the support pin 56 into its idle position. A movement stop is defined by the support surface sections of the support groove 55 in the return section 60 wherein the support surface sections extend transversal to the push in direction Z, wherein the movement stop limits the insertion of the socket 15 into the holder 14. When inserting the socket 15 into the holder 14, the mounting dome displaces the pressure plate 68 illustrated in FIG. 10 against the coil spring 69 also in push in direction Z, wherein the coil spring 69 establishes a spring tension that is oriented against the push in direction Z.

The support groove 55 is configured approximately roof-shaped in the portion of the return section 60, wherein the roof ridge is oriented into the holder recess 64. When the arresting lug 67 reaches the movement stop formed by the return section 60 the socket 15 is released. Due to the roof-shaped support groove 55 in the return section 60 in cooperation with the spring load moving the arresting lug 67 into idle position, the arresting lug 67 slides towards the ridge line wherein a minimum rearward displacement of the socket 15 against the push in direction Z is caused by the spring loaded pressure plate 68. When the arresting lug 67 reaches the ridge portion the reverse displacement movement of the support pin 56 is terminated for the time being. A residual spring tension, however, is maintained for the support pin 56. The arresting lug 67 is located in the arresting section 61 (the ridge) of the support groove 55 and supports the socket 15 against the gravitational direction in the holder 14. The socket 15 is mechanically anchored in the holder 14 (cf. FIGS. 13*a* and 13*b*). Simultaneously there is an electrical connection between the holder contacts and the socket contacts 53.

In order to release the socket 15 from the holder 14, the socket 15 is moved in push in direction Z again. Thus, the arresting lug 67 slides out of the arresting section 61 in a direction of the idle position of the support pin 56 until the arresting lug moves into the support groove 55. The transition from the return section 60 which includes the arresting section 61 into the extraction section 62 is arranged shortly before the point where the arresting lug 67 is in the idle position of the support pin 56. The extraction section 62 itself in return is oriented at an angle relative to the plane including the longitudinal axis of the lamp, however, the extraction section is oriented away from the plane in push in direction Z.

Figure 13B:
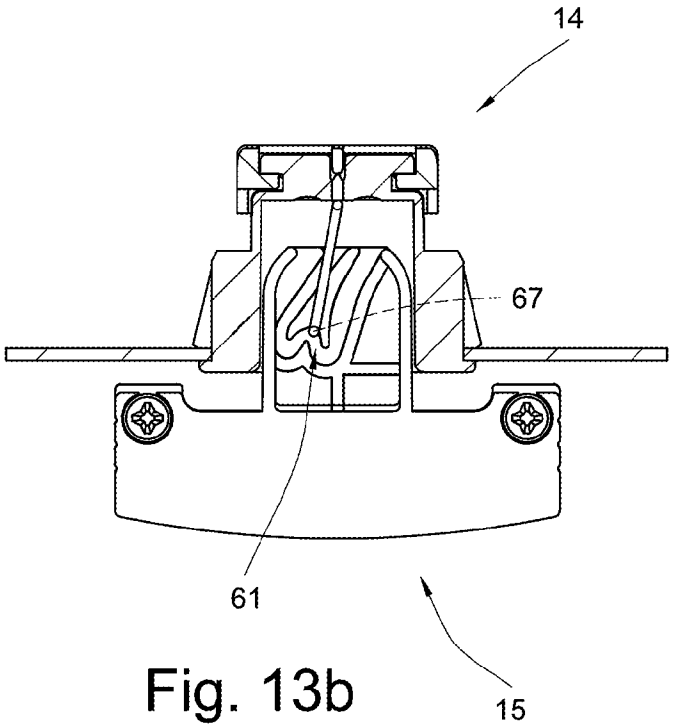
FIGS. 13*a*, 13*b* and 13*c* illustrate a representation of the arrangement portion of lamp socket and lamp holder in order to illustrate the dismounting process.
Figure 13A:
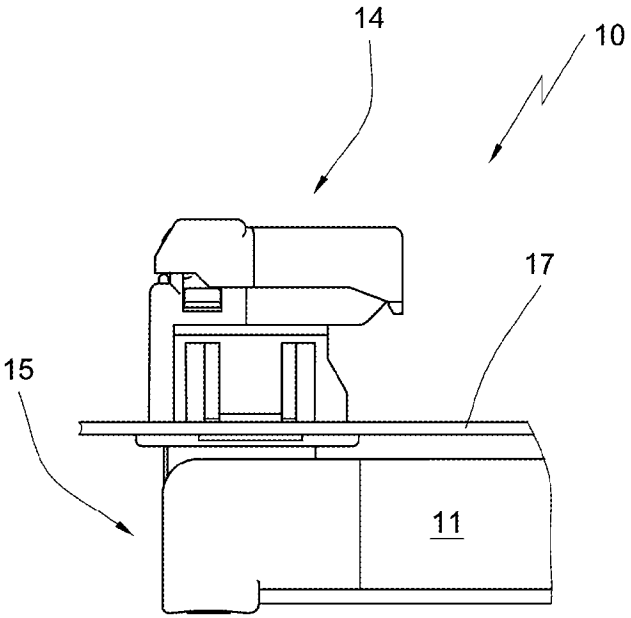
Figure 13C:
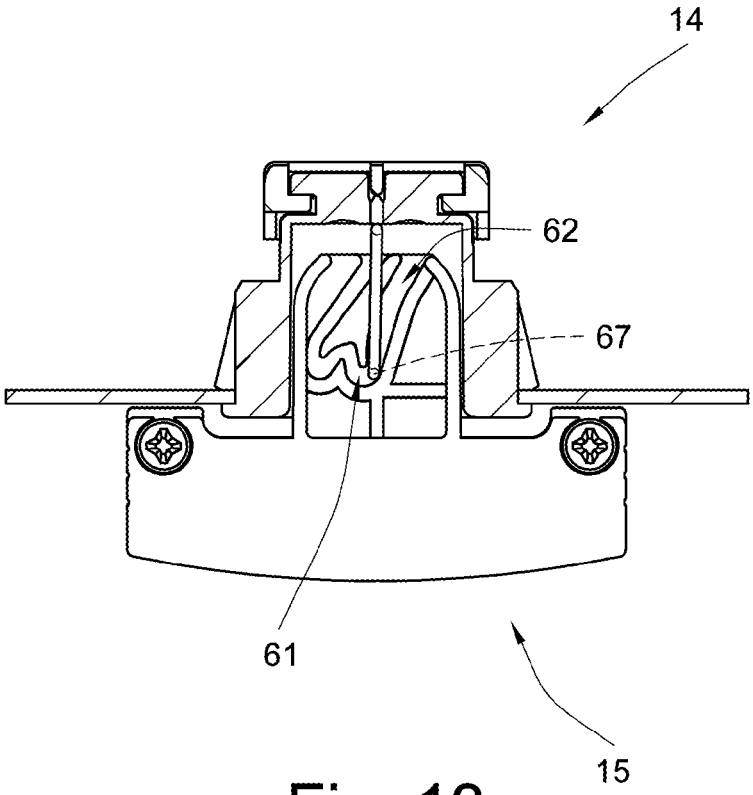

The transition from the arresting lug 67 into the extraction section 62 is illustrated in FIG. 13*c*. Simultaneously the return section 60 forms another movement stop in the transition portion into the extraction section 62 through the support surfaces of the support groove 55, wherein the movement stop prevents further insertion of the socket 15 into the holder 14.

Figure 14B:
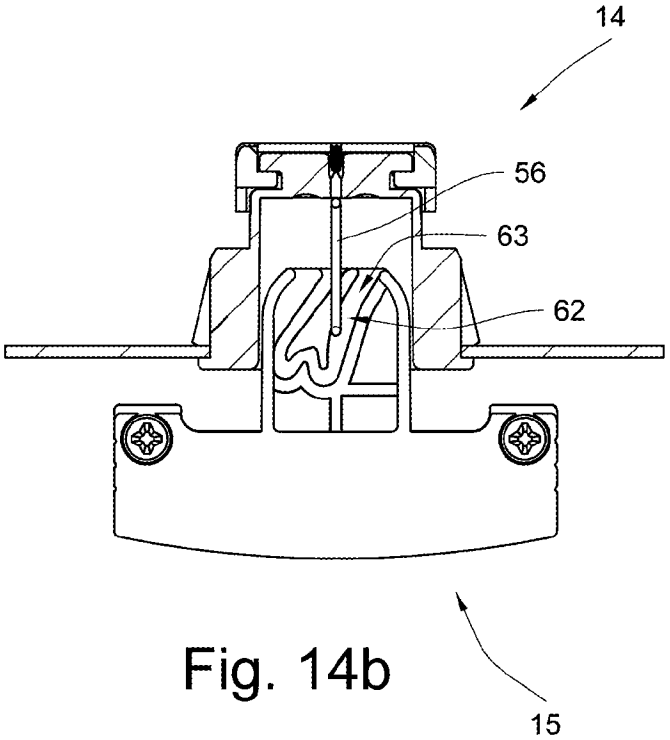
FIGS. 14*a* and 14*b* illustrate a representation of the arrangement portion of lamp socket and lamp holder for emphasizing an extraction position of the lamp.
Figure 14A:
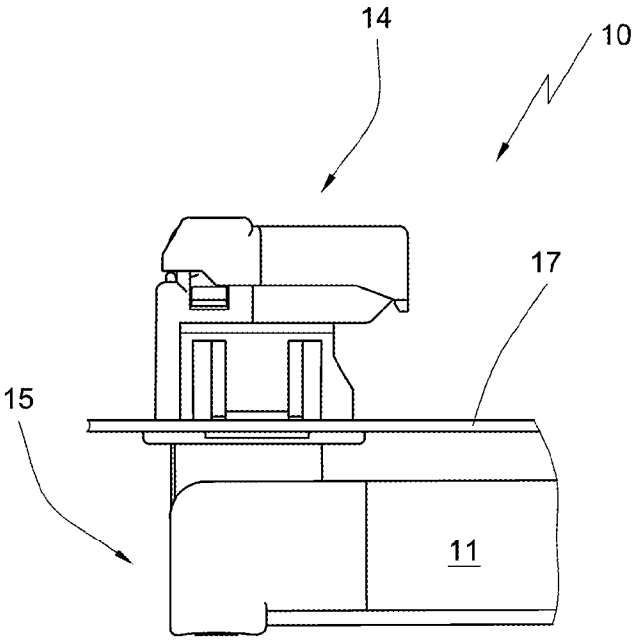

After releasing the socket 15 it slides induced by the spring force of the coil spring 69 against the push in direction Z out of the holder recess 64 until an extraction position is reached. Due to the configuration of the extraction section the outlet movement in return forces a spring elastic displacement of the support pin 56 which is arranged in its idle position in the vertical plane described supra. Thus, the movement of the socket 15 against the push in direction Z when disengaging out of the holder 14 has to be performed against the spring return force of the support pin 56 whose frictional engagement at the support surfaces of the support groove 55 slows down the movement. Advantageously the spring return force or the displacement of the support pin 56 induced by the extraction section 62 is sized so that a reverse displacement of the socket 15 out of the holder 14 against the push in direction Z for example through gravity can only be performed to a certain extent, however, without additional force application by a user this extraction movement is not completed so that the socket 15 is supported in the holder 14 in an extraction position (FIG. 14).

This way it is prevented that the lamp 11 leaves its mechanical anchoring in an uncontrolled manner when unintentionally or intentionally disengaging the socket 15 out of the holder 14 so that unintentional dropping of the lamp 11 out of the light fixture 10 is not possible. Only pulling the socket 15 out of the holder 14 overcomes the frictional engagement and forces the support pin 56 into a displacement which facilitates that the support pin leaves the support groove 55 through the outlet opening 63.

Subsequently, mounting the lamp 11 into the light fixture 10 will be described which uses the method for inserting the support element 13 into the support 12 and also the method for inserting the socket 15 in the holder 14.

Performing this mounting method the support element 13 is initially positioned in front of the opening 26 in the portion of the push in section 27 of the holder 12. The anchor head 38 is moved through the opening 26 into the push in section 27 in push in direction Y. The push in direction Y is then transferred into the push-in direction X through the support surfaces 30. A further movement in push-in direction X of the anchor head 36 leads to its arrangement in the support section 28. If provided the spring arm 41 of the spring 40 included in the support cavity 31 is forced out of its idle position so that it builds up a spring load.

When inserting the support element 13 into the support 12, the lamp 11 is in a position that is inclined relative to the light fixture 10 (c.f. FIG. 2) so that the socket 15 is clearly off-set from the holder 14. Due to the pivotability of the lamp 11 facilitated by the shape of the end section 39 of the anchor head 38, it is now possible to move the socket 15 in push in direction Z towards the holder 14. The pivot movement is thus provided about the anchor head 38 so that the push in movement z actually follows a circular path and is not a strictly linear movement. Due to the large radius which is defined by the length of the lamp 11, the actual insertion movement Z of the mounting dome 51 into the holder recess 64 can be considered a linear movement.

As a continuation of the pivot movement, the mounting dome 51 of the socket 15 moves into the portion of the insertion opening 66 of the holder housing 65 of the holder 14. The mounting dome moves through the insertion opening 66, wherein the arresting lug 67 of the support pin 56 moves through the entry opening 57 into the support groove 55. The mounting dome slides along the displacement section 59 building up a spring load and is displaced in a spring elastic manner. When the arresting lug 67 moves into the transition portion from the displacement section 59 into the return section 60, the support surfaces of the support groove 55 form a movement stop for a movement in push in direction Z.

The movement of the mounting dome 51 into the holder recess 64 causes a spring loaded pressure plate 68 arranged in the holder recess 64 to move in push in direction Z building up a spring load. When the arresting lug 67 has reached the movement stop the socket 15 is released by the user. The spring load impacts the mounting dome 51 through the pressure plate 68 and causes a partial reverse displacement against the push in direction Z, wherein the support pin 56 moves along the support groove into the return section 60 towards its idle position. A roof-shaped section of the return section 60 which forms the actual arresting section 61 facilitates a movement of the arresting lug 67 up to a ridge. When the ridge is reached also the reverse movement of the mounting dome 51 out of the holder 15 induced by the pressure plate 68 terminates. The arresting lug 67 which is inserted in the arresting section 61 of the support groove 55 now supports the socket 15 against the spring loaded pressure plate 68 and the gravitational force in the holder 14. Thus, the socket 15 is mechanically anchored in the holder 14.

When the lamp 11 is mounted in this manner and supported by the socket 15 and the holder 14 on one side, and by the support 12 and the support element 13 on the other side, another advantage of the cooperation of holder 12 and holder element 13 becomes important. When the lamp 11 is mounted the anchor head 38 is supported at a distance from the proximal second face wall 22 arranged in the back in push in direction. Now when the thermal expansion of the lamp 11 recited supra occurs, the anchor head 38 can accordingly move into the support section 28 in X-direction so that there are no damages to the lamp 11 or the light fixture 10. The holder 12 and the holder element 13 thus facilitate compensating the thermal expansion of the lamp 11.

In order to remove the lamp 11 out of the light fixture 10 the socket 15 is again moved into the holder recess 64 in push in direction Z. This leads to a movement of the arresting lug 67 in a direction of the idle position of the support pin 56, wherein the arresting lug 67 leaves the return section 60 and moves into the extraction section 62 arranged opposite to the displacement section 59. The extraction section opens into an outlet opening 63 through which the arresting lug 67 can exit the support groove 55 so that a movement of the socket 15 out of the holder 14 is facilitated.

As described supra, the extraction section 62 forces a movement upon the arresting lug 67 wherein the movement in return leads to a dislocation of the support pin 56 and to a build-up of a spring loading. The spring loading is configured to support the mounting dome 51 against the spring tension of the pressure plate 68 and/or against a possible gravitational force in the holder 14 so that the socket 15 is prevented from falling out of the holder 14 (FIG. 14).

Now an additional force has to be applied by the user, wherein the additional force disengages the socket 15 from the holder 14 and leads to a sliding of the arresting lug 67 out of the support groove 55. After this disengagement of socket the 15 and the holder 14, the lamp 11 in turn has a position that is inclined relative to the light fixture 10 (cf. FIG. 2).

Now the anchor head 38 has to be moved against the push-in direction X out of the support cavity 31 into the push-in section 27. The support surfaces 30 reverse the movement direction into an extraction direction that is opposite to the push in direction Y. The anchor head 38 exits the support 12 through its opening 26 and thereafter mechanical connections between the lamp 11 and the light fixture 10 are disengaged.

In case a support 12 with spring element 40 has been used the spring arm 41 supports the movement against the push-in direction X and induces the dismounting movement. Additionally, the spring arm 41 pushes the anchor head 38 out of the support cavity 31 and into the push-in section 27 also when the lamp is accidentally released when disengaging the socket 15 from the holder 14. This way it is prevented that the forces that are imparted upon the support 12 and in particular the bars 29 by dropping the lamp and a resulting pivot movement destroy the support 12 and in particular the bars 29. Also in case of faulty operations of this type it is assured that the support 12 and thus the light fixture remains intact.

As described supra the socket 15 and the support 12 are used for mechanically anchoring the lamp 11 in the light fixture 10 through an advantageous operating concept which is also known as Push-In and Push-Out concept. This means that the socket 15 has to be pressed into the holder 14 for anchoring and also for disengagement. It is also apparent that a support element and a support can also be configured with omitting holder contacts and socket contacts and corresponding contact support elements wherein the components which are used for mechanical anchoring correspond to the socket 15 and the holder 14. Using a support and a support element thus configured has to be considered equivalent to using the socket and the holder.

Furthermore, it is always apparent to a person skilled in the art that the instant configuration of the holder can also be implemented at the socket and the instant configuration of the socket can be implemented at the holder without incurring any disadvantages or complex configurative requirements. Thus, these solutions are would equivalent.

REFERENCE NUMERALS AND DESIGNATIONS

10 Light fixture
11 Lamp
12 Support
13 Support element
14 Holder
15 Socket
16 Vertical arm
17 Horizontal arm
18 Receiving cavity for lamp 11
19 Supply cavity
20 Base of 12
21 First face wall of 12
22 Second face wall of 12
23 First side wall of 12
24 Second side wall of 12
25 Receiving cavity of 12
26 Opening of 12
27 Push-in section of 26
28 Support section of 26
29 Bar of 12
30 Support surface of 12
31 Support cavity of 28
32 Interlocking device of 12
33 Shoulder of 12
34 Support element base of 13
35 Support element side wall of 13
36 Anchor section of 13
37 Anchor pin of 13
38 Anchor head of 13
39 End section of 38
40 Spring element of 12
41 Spring arm of 12
42 Recess of 17
43 Lamp cover of 11
44 Circuit board of 11
45 LED
50 Front housing wall of 15
51 Mounting dome of 15
52 Contact recesses of 15
53 Socket contact of 15
54 Attachment section of 15
55 Support groove of 15
56 Support pin of 14
57 Inlet opening of 55
58 Free end section of 56
59 Dislocation section of 55
60 Return section of 55
61 Arresting section of 55
62 Extraction section of 55
63 Outlet opening of 55
54 Holder recess of 14
65 Holder housing of 14
66 Insertion opening of 14
67 Arresting lug
68 Pressure plate
69 Coil spring
70 Contact cavity
X Push-in direction
Y Insertion direction
Z Insertion direction

What is claimed is:

1. A light fixture for supporting a lamp at two ends, the light fixture comprising:

a lamp holder which receives and supports a lamp socket arranged at a first end of a lamp, wherein the lamp holder includes lamp holder contacts which electrically connect with lamp socket contacts; and a support which receives and supports a support element arranged at a second end of the lamp, wherein the support mechanically supports the lamp in the light fixture and does not include electrical contacts, wherein the support is essentially pot-shaped, wherein two opposite face walls are arranged at a base of the support, wherein the two opposite face walls support two opposite side walls between each other, wherein the face walls and the side walls define a receiving cavity which is accessible through an opening and which includes a push-in section arranged in front in a push in direction and a support section arranged in a rear in the push-in direction, wherein the lamp holder is provided with a recess for receiving a mounting dome of the lamp socket, wherein a spring element is arranged in the recess, wherein the spring element impacts the mounting dome through a pressure plate, and wherein a support pin is arranged in the recess and linked in a spring-elastic manner.

2. The light fixture according to claim 1, wherein the support section of the support is formed by two bars that are arranged opposite to one another and oriented in the push-in direction, and wherein the two bars narrow the opening in a portion of the support section so that a groove is formed.

3. The light fixture according to claim 2,
wherein a support cavity of the support section is formed between the bars and the base, and
wherein the support cavity is sized so that the support element is essentially supportable in the support cavity without clearance.

4. The light fixture according to claim 3,
wherein at least one support surface is arranged in the receiving cavity of the support,
wherein the at least one support surface controls an insertion movement of the lamp in the push in direction, and
wherein the support cavity is defined by the bars and the support surface.

5. The light fixture according to claim 1,
wherein at least one support surface is arranged in the receiving cavity of the support, and
wherein the at least one support surface controls an insertion movement of the lamp in the push in direction.

6. The light fixture according to claim 5,
wherein the at least one support surface extends from the face wall which is arranged in front in the push-in direction, and
wherein the support surface slopes toward the base.

7. The light fixture according to claim 5,
wherein the support surface extends parallel to the base from the face wall that is arranged in front in the push-in direction, and
wherein the support surface extends to the face wall that is arranged in a rear in the push-in direction.

8. The light fixture according to claim 1,
wherein the face walls and/or the side walls include interlocking devices at their outsides
wherein interlocking device anchor the support in a cut-out of the light fixture element.

9. A lamp for a light fixture, the lamp comprising:
a first end which includes a socket with socket contacts wherein the socket is insertable into a holder at the light fixture,
wherein the socket contacts are electrically connectable with holder contacts,
wherein the socket is mechanically supportable at the holder; and
a second end which includes a support element which is insertable into a support at the light fixture,
wherein the support element is mechanically supportable at the support and does not include electrical contacts,
wherein the socket includes a mounting dome that is insertable into the holder,
wherein the mounting dome includes support surfaces which form a movement path for a support pin that is linked at the holder in a spring elastic manner and which mechanically anchors the socket in the holder,
wherein the movement path guides the support pin when the mounting dome and the holder are inserted into each other,
wherein the movement path includes a displacement section that displaces the support pin from an idle position in a first direction while building up a spring load in the support pin,
wherein the movement path includes a return section which returns the support pin towards its idle position reducing the spring load in the support pin,
wherein the movement path includes an arresting position for the support pin which forms a portion of the return section and maintains a residual spring load.

10. The lamp according to claim 9, wherein an anchor section of the support element includes an anchor head which is fixated at a side wall of the support element through an anchor pinion.

11. The lamp according to claim 10, wherein the anchor pinion is narrower than the anchor head and the anchor section is configured overall substantially T-shaped.

12. The lamp according to claim 10, wherein the anchor head is formed drum-shaped at least at its end sections.

13. A method for mechanically fixating the lamp according to claim 10 in a light fixture for supporting the lamp at two ends, the light fixture including:
the holder which receives and supports the socket arranged at a first end of the lamp, wherein the holder includes lamp holder contacts which electrically connect with the socket contacts; and a support which receives and supports the support element arranged at a second end of the lamp,
wherein the support mechanically supports the lamp in the light fixture and does not include electrical contacts,
wherein the support is essentially pot-shaped,
wherein two opposite face walls are arranged at a base of the support,
wherein the two opposite face walls support two opposite side walls between each other, wherein the face walls and the side walls define a receiving cavity which is accessible through an opening and which includes a push-in section arranged in front in a push-in direction and a support section arranged in a rear in the push-in direction,
wherein the holder is provided with a recess for receiving the mounting dome of the socket,
wherein a spring element is arranged in the recess,
wherein the spring element impacts the mounting dome through a pressure plate, and
wherein a support pin is arranged in the recess and linked in a spring-elastic manner,
the method comprising the steps: moving the anchor section of the support element in a first linear movement through the opening into the receiving cavity of the support and there into the push-in section, and
inserting the anchor section of the support element in a second linear movement into the support section of the receiving cavity of the support.

14. The method according to claim 13 using the light fixture,
wherein the support section of the support is formed by two bars that are arranged opposite to one another and oriented in the push-in direction, and
wherein the two bars narrow the opening in a portion of the support section so that a groove is formed, wherein the anchor section of the support element includes an anchor head which is fixated at a side wall of the support element through an anchor pinion, wherein the anchor pinion is narrower than the anchor head and the anchor section is configured overall substantially T-shaped, wherein the anchor head is inserted into the push-in section and pushed into the support section, and wherein the anchor pin is pushed between the bars forming the groove.

15. The method according to claim 13, using a light fixture
wherein at least one support surface is arranged in the receiving cavity of the support,
wherein the at least one support surface controls an insertion movement of the lamp in the push in direction, and wherein the support surface switches the first linear movement into a second linear movement.

16. The lamp according to claim 9, wherein a continued relative movement of the holder and the mounting dome disengages the support pin from the arresting section, moves the support pin from the return section into an extraction section of the movement path while reducing the residual spring load to zero.

17. The lamp according to claim 16, wherein the extraction section is configured to displace the support pin in a second direction building the spring load up again, and wherein the second direction is opposite to the first direction of displacement.

18. The lamp according to claim 9, wherein the support surfaces are associated with a support groove that is fabricated into a side wall of the mounting dome.

19. The lamp according to claim 18, wherein the support groove extends from an inlet opening through which the support pin is insertable into the support groove, and wherein the support groove terminates in an outlet opening through which the support pin is extractable.

20. A method for mechanically fixating the lamp using the support element according to claim 9 and a light fixture for supporting the lamp at two ends, the light fixture comprising:

the holder which receives and supports the socket arranged at a first end of the lamp, wherein the holder includes lamp holder contacts which electrically connect with the socket contacts; and a support which receives and supports the support element arranged at a second end of the lamp, wherein the support mechanically supports the lamp in the light fixture and does not include electrical contacts, wherein the support is essentially pot-shaped, wherein two opposite face walls are arranged at a base of the support, wherein the two opposite face walls support two opposite side walls between each other, wherein the face walls and the side walls define a receiving cavity which is accessible through an opening and which includes a push-in section arranged in front in a push-in direction and a support section arranged in a rear in the push-in direction, wherein the holder is provided with a recess for receiving the mounting dome of the socket, wherein a spring element is arranged in the recess, wherein the spring element impacts the mounting dome through a pressure plate, and wherein a support pin is arranged in the recess and linked in a spring-elastic manner, and for electrically contacting the lamp and the light fixture, wherein the mounting dome is inserted with a mounting movement in a mounting direction into the recess at the support, wherein the support pin impacts at least one support surface of the displacement section of the movement path and the pressure plate at the holder is displaced by a first distance while building up a spring tension.

21. The method according to claim 20, wherein the support pin slides during a mounting movement along the displacement section of the movement path and penetrates the return section at an end of the mounting movement until the support pin is anchored in the arresting section.

22. The method according to claim 21, wherein a dismounting movement is performed for disengaging the arrested support pin, wherein the dismounting movement is initially performed in the same direction as the mounting movement.

23. The method according to claim 22, wherein a continued relative movement of the holder and the mounting dome disengages the support pin from the arresting section, moves the support pin from the return section into an extraction section of the movement path while reducing the residual spring load to zero, and wherein the support pin moves into the extraction section when performing the dismounting movement.

24. The method according to claim 23, wherein the extraction section is configured to displace the support pin in a second direction building the spring load up main, wherein the second direction is opposite to the first direction of displacement, and wherein the support pin is supported by the extraction section of the movement path when continuing the dismounting movement in a reversal of the movement direction under renewed spring elastic displacement of the support pin.

25. The method according to claim 24, wherein the continuing dismounting movement with the movement direction opposite to the mounting movement is induced by the spring-loaded pressure plate of the support until the extraction position is reached.

* * * * *